US009981289B2

(12) United States Patent
Woodgate et al.

(10) Patent No.: US 9,981,289 B2
(45) Date of Patent: May 29, 2018

(54) SCREEN PANEL LOCKING SYSTEM

(71) Applicant: Lettela Pty Limited, Airport West (AU)

(72) Inventors: Raymond Maxwell Woodgate, Bacchus Marsh (AU); Marc Raymond Woodgate, Bacchus Marsh (AU)

(73) Assignee: Lettela Pty Limited, Victoria (AU)

( * ) Notice: Subject to any disclaimer, the term of this patent is extended or adjusted under 35 U.S.C. 154(b) by 0 days. days.

(21) Appl. No.: 15/278,214

(22) Filed: Sep. 28, 2016

(65) Prior Publication Data

US 2017/0087594 A1 Mar. 30, 2017

(30) Foreign Application Priority Data

Sep. 28, 2015 (AU) ..... 2015903944

(51) Int. Cl.
*B07B 1/49* (2006.01)
*B07B 1/46* (2006.01)

(52) U.S. Cl.
CPC ..... *B07B 1/4645* (2013.01); *B07B 2201/02* (2013.01)

(58) Field of Classification Search
CPC ..... B07B 1/46; B07B 1/4645
USPC ..... 209/404, 405
See application file for complete search history.

(56) References Cited

U.S. PATENT DOCUMENTS 4,670,136 A * 6/1987 Schmidt ..... B07B 1/4645 209/399
5,277,319 A * 1/1994 Henry, Jr. ..... B07B 1/46 209/399
5,377,846 A * 1/1995 Askew ..... E04C 2/42 209/399
7,841,476 B2 * 11/2010 Johnson ..... B07B 1/4645 209/392
8,434,625 B2 * 5/2013 Angus ..... B07B 1/42 209/405
2002/0195377 A1 * 12/2002 Trench ..... B07B 1/284 209/365.1
2006/0175233 A1 * 8/2006 Zubovich ..... B07B 1/4645 209/680
2013/0037459 A1 * 2/2013 Woodgate ..... B07B 1/4645 209/405
2015/0290682 A1 * 10/2015 Paul ..... B07B 1/4645 209/405

(Continued)

*Primary Examiner* — Terrell H Matthews
(74) *Attorney, Agent, or Firm* — Woodard, Emhardt, Moriarty, McNett & Henry LLP; Charles Reeves

(57) ABSTRACT

A screening apparatus includes elongate beams and screen panels mounted to the beams to form a broad screening surface. Each of the panels are mounted so that side edges of adjacent panels are in facing relationship. Each panel is mounted to a pair of beams to bridge between two adjacent beams. The panels are mounted to the beams by fixing members. The fixing members have a pair of upstanding rails that are spaced apart to define a longitudinal gap between them. The panels are mounted to the beams by cooperation between the side edges with a rail of a fixing member. Cover strips extend along the beams and include a cover portion and a locking portion. The cover portion bears against an upper surface of a pair of adjacent panels and the locking portion bears against facing surfaces of the rails to resist movement of the rails towards each other.

17 Claims, 9 Drawing Sheets

(56) References Cited

U.S. PATENT DOCUMENTS

2016/0136690 A1* 5/2016 Woodgate ..... F16B 5/0032
209/408

* cited by examiner

SCREEN PANEL LOCKING SYSTEM

CROSS REFERENCE TO RELATED APPLICATIONS

This application claims priority to Australian Patent Application No. 2015903944 filed on Sep. 28, 2015, which is hereby incorporated by reference in its entirety.

TECHNICAL FIELD

The present invention relates generally to apparatus for screening, separating or grading materials, and is principally for use in the mining industry. The present invention is particularly directed to arrangements for fixing screen panels to the support frame of a vibratory screening machine and to the screen panels themselves. The system and panels are applicable for screening, separating and grading ores and other materials, and it will be convenient to hereinafter describe the invention in relation to that use. It is to be appreciated, however, that the invention is not limited to such apparatus and use.

BACKGROUND OF INVENTION

A reference herein to prior art is not to be taken as an admission that the prior art was known or that it was part of the common general knowledge as at the priority date of any of the claims.

Screening apparatus of the type with which the invention is concerned is generally used for screening, grading, or separating materials such as ores and comprises an array of screen panels which are removably fixed to a frame to provide a continuous screen deck. The material to be screened is fed onto the deck at one end and the apparatus is vibrated so that the material moves over and through its screening surface.

The screen panels in a screen deck are usually subject to wear, due to the abrasiveness of the mining materials typically being screened, and thus the screens require periodical replacement. This presents a difficulty with the attachment of the panels to the deck frame, as the attachment must be secure and robust and easily made, but it should also be releasable in a manner that is quick and easy. Applicant has developed several different forms of screen panel attachments, examples of which can be found in Australian patent no. 2012201297 and Australian patent no. 2012208984.

In addition to the need for screen panels to be easily attachable and releasable to and from a screen deck, screen panels should also be firmly secured in place on the deck and the screen array should not present or at least minimise gaps for passage of screening product or media other than through the openings formed in the screens themselves. If gaps do exist, then incorrect grade screening product can pass through the deck, or the screening product can become embedded between components of the screening deck and can cause wear. This can result in the need to clean parts of the vibratory machine or replace parts, either of which results in downtime of the vibratory machine.

Screen decks are therefore formed with either the side edges of adjacent screen panels abutting, or with cover strips employed between adjacent screen panels to overlie any gaps between the adjacent side edges. The present invention relates to screen decks that employ such cover strips.

By the use of cover strips, a screen deck can thus usually be formed without any gaps between adjacent panels being open for passage of screening product or media. That is, if gaps exist, the cover strips will overlie the gaps so that the screening product or media cannot enter the gaps.

Prevention of the entry of screening product or media into gaps between adjacent panels can also be provided by cover strips even if there is movement of the screen panels relative to one another during operation of the vibratory machine that causes gaps to be formed that were not formed prior to the vibratory machine being operated. For example, gaps that were not present when the screen panels were put in place can form once the vibratory machine is operated and the screen panels are subject to vibratory motion.

One form of movement that can create gaps is movement of screen panels in the direction of travel of the screening product over the screening deck. This type of movement is more likely to occur in so-called multi-slope or "banana" screening decks, in which the lead or initial section of deck is inclined or curved to increase the speed of the screening product across the initial section of the screening deck. Such screening decks can also provide other benefits or effects such as to promote water shedding from the screening product and so their use is often preferred. In that inclined or curved section of the screening deck, the screening product moves at high speed and the forces associated with that movement tends to push the screen panels in the direction that the screening product travels. If the screen panels move under that load, gaps between panels can arise.

The present invention seeks to provide a new arrangement in which cover strips are employed and which in some forms of the invention, with use of those cover strips, movement of screen panels in the manner described above is minimised or eliminated. The elimination of movement is intended once the screen panels have been finally positioned, such that in some forms of the invention, movement of the screen panels is advantageously allowed for installation purposes, but movement is prevented once the panels have been installed.

SUMMARY OF INVENTION

According to the present invention there is provided a screening apparatus, including:

a plurality of spaced apart, substantially parallel elongate beams, a plurality of screen panels mounted to the beams to form a broad screening surface, each of the panels having a generally square or rectangular shape defining a first pair of substantially parallel side edges and a second pair of substantially parallel side edges, and the panels being mounted adjacent to each other so that side edges of adjacent panels are in facing relationship, each panel being mounted to a pair of beams to bridge between two adjacent beams, the panels being mounted to the beams by elongate fixing members that extend in the longitudinal direction of the beams and that engage the first pair of side edges of the panels, the fixing members having a pair of upstanding, generally longitudinal flexible rails that are generally parallel and that are spaced apart to define a longitudinal gap between them, the panels being mounted to the beams by cooperation between the first pair of side edges of each panel with a rail of a fixing member, elongate cover strips extending lengthwise of the elongate beams and including a cover portion and a locking portion, the cover portion overlying and bearing against an upper surface of a pair of adjacent panels at the first side edges of the adjacent panels, and the locking portion extending into the gap between the longitudinal rails and bearing against facing surfaces of the longitudinal rails to resist movement of the rails towards each other.

A screening apparatus as above described advantageously secures the screen panels in place on the fixing members, with the cover strips acting to maintain the rails of the fixing members spaced apart so that the side edges of each panel remain in firm connection with the rails. Thus, the cover strips do not need to be load bearing other than to remain in position in bearing engagement with the upper surface of adjacent panels at the first side edges and to bear any load tending to push the rails of the fixing members together. The cover strips act to protect against ingress of screening media between facing side edges of adjacent panels by overlying the gap between facing side edges. This allows the connection of the cover strips in the screening apparatus to be relatively light or insubstantial subject to the connection being able to resist the vibratory loads imposed on the cover strips during operation of screening apparatus according to the invention.

The connection which is required to connect the cover strips to adjacent panels also facilitates ease of installation where cover strips are employed. The connection is such as to require only moderate force to install and can be easily manually installed, with the use of a mallet where required. The connection is also quick to achieve.

In the above form of the invention, the fixing members can be fixed to the elongate beams, and thereafter, the screen panels can be fitted to the fixing members. That can occur before the cover strips are installed. The fixing members can be fixed to the beams in any suitable manner, such as is known in the art, or as is disclosed in other patent applications filed by the present applicant. For example, in beams formed from angle section, the fixing members can include downward projections (studs or pins for example), which can extend through openings in the beams, and which can be secured to the beams by threaded nuts. The fixing arrangements can alternatively be suitable for "pipe-top" beams, and one form of fixing arrangement for that form of beam is disclosed in Australia patent application 2012211453 in the name of the present applicant.

The screening panels are mounted to the beams by cooperation between the first pair of side edges of each panel with a rail of a fixing member. That cooperation can take any suitable form and in some forms of the invention, a nesting arrangement is adopted, whereby facing surfaces of the first pair of side edges of a screen panel and the rails of a pair fixing members which are fixed to two adjacent beams, are arranged for nesting engagement. One example of that form of cooperation is the use of nesting grooves and projections. For example, the rails of a fixing member can include an outwardly extending projection that nests within an inwardly extending groove, recess or channel of a facing side edge of a screening panel. Alternatively, the opposite arrangement could be provided whereby the rail of a fixing member includes a groove, recess or channel, into which a projection that extends from a side edge of a screening panel can extend. The arrangement could include multiple projections and grooves and in some forms of the invention, each of the side edges of the screening panel and the rails of a fixing member include both a projection and a groove, recess or channel. The projections and the grooves, recesses or channel will extend in the lengthwise direction of the beams and while they can be continuous there is no requirement for these to be continuous.

In some forms of the invention, side edges of a screen panel include a projection for entry into a groove or recess of the fixing rail and the arrangement of the present invention advantageously allows this by providing for flexing movement of the rail to allow the rail to move inwardly, so that the side edge projection can move past the upper end of the rail and into the groove or recess. The projection itself might also have some flexibility to facilitate movement relative to the upper end of the rail, while the surface of the upper end of the rail can be inclined to facilitate sliding or riding movement of the projection over the upper end of the rail and into the groove or recess. By this ability to flex inwardly, it is relatively easy to connect a panel to the fixing member by hand. Given that both rails of a fixing member are flexible, the connection of first edges of adjacent or facing panels to a single fixing rail is also relatively straight forward and easy. This is particularly the case where the gap or channel that is provided between the upstanding rails allows full movement of each rail despite that one rail might already have been engaged by the side edge of a screening panel. That is, the rails can move independently to each other and movement of a rail to which a panel is being connected can be provided despite that the other rail of the fixing member might already be connected to the side edge of a panel.

It is once the side edges of a pair of adjacent panels have been connected to or engaged with the rails of a fixing member, that the locking portion of a cover strip is inserted into the gap or channel between the rails of the fixing member. Once this happens, the locking portion will force or retain the rails in secure engagement with the side edges of the screening panels and will prevent the rails from shifting out of that engagement. Thus, the rails are prevented from flexing inwardly as they can do when the locking portion is not within the gap between the rails and by preventing inward flexing, disengagement of a side edge from a rail is prevented. The panels thus are securely fixed to the fixing members against release from that connection or engagement, while the cover portion of the cover strips acts to prevent ingress of screening media into the area between facing edges of adjacent panels where the fixing member is positioned.

To remove a panel, the cover strip is removed to allow inward flexing movement of a rail or rails of a fixing member and this facilitates disengagement of a side edge from a rail. If the cover strip extends for more than a single screen panel, then only that section of cover strip that interacts with the rails of the fixing member that secures the panel to be removed needs to be removed. As will become apparent hereinafter, connection and disconnection of a cover strip with the fixing rails is a simple and easy process.

For similar reasons as given for providing inclined surfaces of the upper ends of the rails of the fixing members, the projections and grooves that form the cooperation between the side edges of the screen panels and the rails can include inclined or chamfered edges to facilitate entry of a projection into a groove. In addition, the leading end or edge of the locking portion can be formed to have a generally triangular or curved cross-section or face. This is useful where there is engagement between the leading end or edge of the locking portion and the faces of the side edges of the screening panels as the locking portion is installed so that the leading end or edge can slide or ride over those faces, or to slide or ride over upper edges of the rails of the fixing members and into the gap between those rails.

The cover strip can cooperate with the screen panels to secure the cover strips in place or the fixing members can secure the cover strips in place or there can be a combination of both. For example, the locking portion can engage one or both of the facing surfaces of the rails of the fixing members such as through cooperating projections and grooves or through cooperating flanges and lips. The locking portion can alternatively engage with the one or both of the side edges of adjacent panels. Again, this can be through cooperating projections and grooves or through cooperating flanges and lips.

In some forms of the invention, the side edges of adjacent panels can overlie each of the upper ends of the rails that form part of each fixing member. Where the side edges include such overlying portions, the locking portion of the cover strips can cooperate with the overlying portions in order to retain the cover strips in place. In the above arrangement, the locking portion of the cover strips can cooperate with the overlying portions through cooperating projections and grooves or through cooperating flanges and lips. The locking portion of the cover strips can for example, cooperate with the overlying portions by engagement with an underneath portion or surface of the overlying portions.

For example, the locking portion of the cover strips can include a web section that extends from the cover portion, as well as a head that is positioned at the free end of the web section spaced from the cover portion. The head can extend laterally on either side of the web section to form lateral bearing surfaces, which bear against facing surfaces of the side edges of the panels, in particular the overlying portions of the panels. This arrangement is particularly suited for panels that include overlying portions, because the lateral bearing surfaces can face upwardly and bear against a downwardly facing surface of the overlying portions. It is noted that because the cover strips are under very little load during operation of a screening apparatus according to the invention, the securing load required to secure the cover strips in place is low and therefore the overlap between the respective bearing surfaces of the head and the overlying portions, can be quite small. For example, testing to date indicates that an overlap of approximately 1.5 mm is all that is needed between the respective bearing surfaces. The gap of course could be greater (or even lesser) such as 2 mm or 3 mm. This testing has been undertaken where the lateral bearing surfaces of the head are substantially parallel with the plane of the screening surface and the bearing surfaces provided by the overlying portions are in substantially the same plane. This level of overlap would also apply to alternative arrangements where cooperation between the cover strips and the screen panels or fixing members is by cooperating projections and grooves or through cooperating flanges and lips.

The locking portion of the cover strip can extend into the gap between adjacent rails of a fixing member in any suitable manner and to any suitable extent. In the above arrangement in which the locking portion includes a head, then the head can be positioned within the longitudinal gap and the width of the head can be substantially equal to the width of the longitudinal gap. In this arrangement, upon insertion of the head into the longitudinal gap, the head will bear against facing surfaces of the rails and will resist movement of the rails towards each other in accordance with the invention. It will be appreciated that by the time the locking portion is inserted into the longitudinal gap, a pair of panels will have already been fixed to the rails of the fixing member and thereafter, installation of the cover strip is the final step to secure the panels to the fixing members. As indicated above, a cover strip according to the present invention can be quite easily installed manually, with the use of a hammer or mallet if necessary, while removal of a cover strip is also relatively simple given the low load needed for that removal. Despite this, the cover strips can be securely positioned in place against release, so that the integrity of a screening surface as formed according to the present invention, is unlikely to be compromised during operation of the screening apparatus.

In the above arrangement in which the locking portion includes a head that defines lateral bearing surfaces, the overlying portions of the adjacent panels can overlie the upper end of the rails of the fixing members to be positioned to overlie the gap between those rails or to project to a position that is over the gap. This allows the facing bearing surface that is provided by the overlying portions to be that surface which overlies the longitudinal gap, and means that the head which extends across the full width of the gap can include upwardly facing bearing surfaces within the longitudinal gap that can bear against the parts of the overlying portions that extend into or over the longitudinal gap.

Much of the above discussion has concerned fixing of the cover strips in place by cooperation between the locking portion of the cover strips and the side edges of adjacent panels. While this is one arrangement, it is to be noted that in alternative arrangements, the locking portions of the cover strips could cooperate with facing surfaces of the longitudinal rails in order to retain the cover strips in place. These arrangements might include one or more projections that extend from the facing surfaces of the longitudinal rails for entry into grooves that are formed in the locking portion. The opposite arrangement could also apply whereby grooves are formed in facing surfaces of the rails and projections extend from the locking portion.

What is important is that the cover strips are firmly held in place so that there is bearing engagement of the cover portion against an upper surface of a pair of adjacent panels and preferably that bearing engagement is firm bearing engagement.

The above form of the invention concerns a screening apparatus in which a cover strip is employed which not only bears against upper surfaces of adjacent screening panels to resist ingress of screening media between the panels, but also includes a locking portion which prevents the upstanding rails of the fixing members from flexing inwardly once the screen panels have been connected to the fixing members. In a further development of this form of the invention, the cover strips can also include an arrangement to cooperate with both the fixing members and the screen panels, to prevent movement of screen panels in the direction of travel of the screening product or media over the screening deck. This movement has been discussed above and is the cause of gaps being formed between screen panels, which can either allow the pollution of screened material by incorrectly graded material passing through or past the screen panels, or can allow ingress of screened material into areas of the screening apparatus that will wear as a result of that ingress.

According to the present invention, each of the rails of each fixing member and each of the first side edges of the screening panels, can be interrupted to form locating gaps. These gaps need be formed so that the gaps of the rails align with the gaps of the side edges of the panels when the panels are positioned in a screening deck, and prior to insertion of a cover strip. In this arrangement, the cover strips can include locking members that extend into the aligned locating gaps, and because the fixing members are fixed in place on the elongate beams, the entry of the locking members into the aligned locating gaps prevents movement of the screening panels relative to the fixing members. By fixing the screen panels against movement in this manner, movement of the screen panels in the direction of travel of screening product or media over the screening deck is prevented, so that gaps that might otherwise open as a result of such movement, do not open.

The cover strips can include the locking members in any suitable manner, but in some forms of the invention, the locking members are formed as part of the locking portion of the cover strips. Because the locking portion is inserted into the longitudinal gap between the flexible rails of the fixing members, the locking members can be formed on either side of the locking portion for alignment with the locating gaps of the fixing members and screen panels. These can be formed at any suitable positions on either side of the locking portion dependent on the position of the locating gaps. Having the locking members at the same position at either side of the locking portion is preferred as that means that there is no particular orientation for the cover strip to be inserted. That is, it is not necessary for installation personnel to orient the cover strip to align offset locking members on either side of the locking portion, but rather, it is simply necessary for the locking members on either side of the locking portion to be inserted into the aligned locating gaps that are presented once the screen panels have been connected to the fixing members.

In some forms of the invention, the first pair of edges of each screen panel will include a single locating gap and aligned locating gaps will be formed in the fixing members. In other forms of the present invention, the first pair of edges of each screen panel includes two locating gaps that are spaced apart along the first pair of edges and which are preferably spaced apart towards opposite ends of the first pair of edges. Complementary locating gaps are formed in the rails of the fixing members to align with the spaced apart locating gaps of the first pair of side edges of each screen panel.

The locking members of the cover strips preferably completely fill the locating gaps which are formed in alignment between the rails of the fixing members and the side edges of each screen panel. In some forms of the invention, the locking members have longitudinally spaced bearing surfaces for engagement with longitudinally opposite surfaces of the aligned locating gaps of the edges of the screen panels and the rails of the fixing members. It is preferred that the bearing surfaces of the locking members are in permanent engagement with the opposite surfaces of the aligned locating gaps, so that as soon as there is a load applied tending to shift the screen panels in the direction of travel of the screening product or media, that that load is immediately resisted by the bearing surfaces of the locking members.

It is to be noted that the loading tending to shift the screen panels might not just be by way of screening product or media that travels over the screening surface of the screening apparatus, but other loads promoting screen panel movement might occur as a result of the vibrations that screening apparatus according to the present invention is subject to. The arrangement of locking members and aligned locating gaps is intended to resist screen panel movement under these other loads.

The fixing members of the present invention can have any suitable length. In some forms of the invention, a fixing member will have a length which is substantially equal to the length of the first edges of each screen panel. Alternatively, the fixing members can be of a greater length such as twice the length of the first pair of side edges of a panel, or three, four or five times that length. Greater lengths are possible and are limited in some forms of the invention only by the moulding processes that are employed to mould fixing members, as presently, they are generally formed from polyurethane.

In addition, the screen panels for use in the present invention can be integral panels, or two-part panels for example. Integral panels include those panels that have an internal metal frame about which a skin is moulded, such as a polyurethane skin. The metal frame supplies the rigidity that the panel requires, while the polyurethane skin includes the screening openings and provides some flexibility, so that under vibration, the polyurethane screening surface can oscillate, thereby tending to shake screening media out of the openings that otherwise might block the openings.

Two-part screening panels typically include a base frame and an overlying screen. These are similar to the form of integral screen discussed above, which comprises a metal frame and a moulded polyurethane skin, but in the two-part form, the skin is attachable to and removable from the base frame. The base frame could also be formed in a manner that includes an internal metal frame and an external moulding, or it might be a single moulding of a more rigid base material, such as nylon. The benefit of the two-part arrangement, is that the skin can be replaced following wear or other damage, without needing to replace the base frame. This means that the replacement can be less costly, because only one part of the panel is to be replaced, while the base frame might be able to remain in place on the beams of the screening apparatus, without being required to be completely removed.

BRIEF DESCRIPTION OF DRAWINGS

In order that the invention may be more fully understood, some embodiments will now be described with reference to the figures in which.

DETAILED DESCRIPTION

Figure 1:
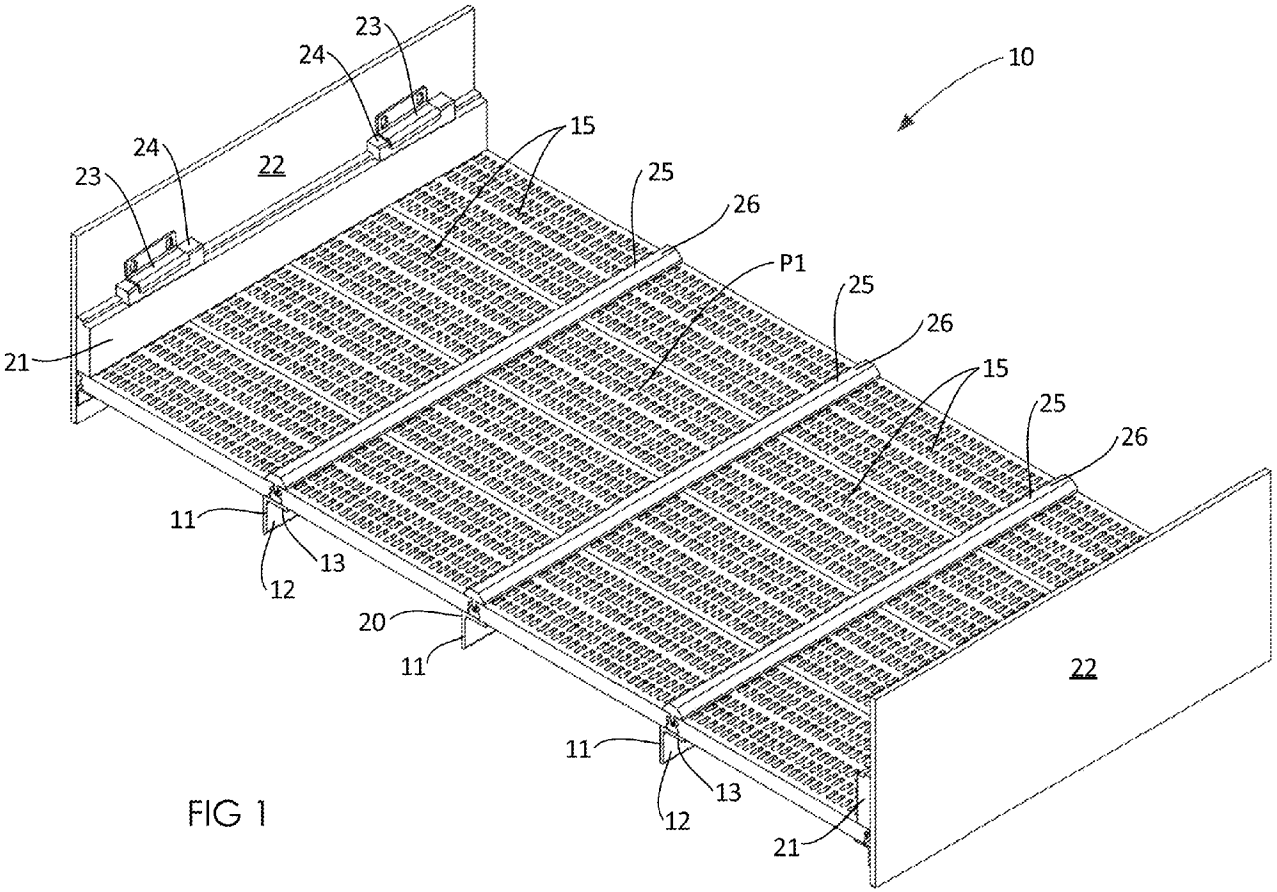
FIG. 1 is an isometric view of a portion of a screening deck according to one embodiment of the invention.

With reference to FIG. 1, a portion of a screening deck 10 is illustrated, comprising a plurality of elongate, longitudinal beams 11 each of which is formed from an angle of steel having a long portion 12 and short portion 13. The portions 12 and 13 are set at right angles to each other. The beams 11 extend in the longitudinal direction of the screening deck 10, although they can equally extend perpendicular to the direction shown.

The deck 10 illustrated in FIG. 1 is a portion of a deck only and illustrates a depth of four screening panels 15 in the longitudinal direction of the screening deck 10. The longitudinal length of the deck 10, in the direction of the beams 11 can be much greater.

The beams 11 extend parallel to one another and support the panels 15 on the upper face of the short portion 13 of each beam 11. The panels 15 illustrated in FIG. 1 can be of any suitable size, but a common size is 305 mm by 610 mm. The screening deck 10 is one part of an overall screening apparatus. The screen deck 10 is supported on a sub frame which includes the beams 11 and which is part of a vibratory screen machine. The vibration that is generated is significant and requires the panels 15 to be securely fixed to the beams 11. The panels 15 are also subject to wear over time and even though the fixing of the panels 15 to the beam 11 are required to be secured, the preference is that the panels are also easily releasable to facilitate replacement.

The panels 15 include a plurality of openings through the top surface thereof for screening product such as mining ore. The openings in the panel can vary from large to very small depending on the screened media required from the screening process.

Typically, ore is fed onto one end of the deck 10 and the deck is vibrated so that the ore tends to shift from one end to the other with some of the ore passing through the openings of the panels 15 as it travels over the deck. Depending on the operation, the valuable ore could be the ore which passes through the openings, or the ore which remains on the deck. The panels 15 are attached to the screen deck 10 via elongate fixing members 20. The fixing members are fixed to the upper surface of the short portion 13 of the beams 11 by any suitable arrangement, such as bolts. The fixing rails can extend for a single length of a single panel 15, or, more preferably, for a greater number of panels, such as four or five panels.

Most of the panels 15 will be in face to face engagement alongside edges of each panel. For example, the panel marked $P_1$ is engaged on all four edges by other adjacent panels. It is preferred that the panels have this face to face engagement, in order to prevent or minimise screening product from entering into the junction between adjacent panels 15 and through that junction to the beams 11 below or into the screened product that is collected below the screen deck. Any entry of such screening product between adjacent panels 15 can cause wear to the fixing members 20, or to the beams 11, thus compromising operation of the screening deck 10. With sufficient wear, worn components must be replaced and that results in down time of the screening apparatus. Wear of certain components, such as the beams 11, can require significant down time in order to replace the components. It is therefore important that the panels 15 be fixed to the deck 10 securely and with firm side edge engagement between adjacent panels.

It is to be noted that the deck 10 includes side clamps 21 at each side of the deck 10, and in facing engagement with side walls 22. Side clamps 21 clamp via a bracket 23 and wedge 24 onto the upper edge surface of the panels 15 for the purpose of preventing ingress of screening product between the side edges of the panels 15 and the walls 22, and also to protect the walls 22 (which are usually steel walls), from the impact of screening product which traverses the screen deck 10. The side clamps 21, like the panels 15, are usually made from a polyurethane material. The side clamps can be used with a screening apparatus of the invention or with prior art screening apparatus.

In general, the screening deck 10 as shown in FIG. 1 has similar characteristics to other screening decks, in that a plurality of panels are spaced apart adjacent each other to form a broad screening surface. As shown in FIG. 1, each of the panels 15 has a generally square or rectangular shape defining a first pair of substantially parallel side edges that are fixed by the fixing members 20 to the beams 11, and a second pair of substantially parallel edges that bridge between adjacent beams 11. Accordingly, each of the panels 15 is mounted to a pair of beams 11 to bridge between those beams 11.

The fixing members 20 will be described in more detail in figures that follow, but also evident from FIG. 1 is the provision of elongate cover strips 25 that extend lengthwise of the elongate beams 11 and which include a cover portion and a locking portion. The cover portion 26 is clearly evident in FIG. 1 and is shown as overlying and bearing against upper surfaces of a pair of adjacent panels 15 above the short portion 13 of the beams 11 and it will be apparent form the figures that follow, that the cover strips 25 also include a locking portion that cooperates with the fixing members 20 to lock the screening panels 15 to the screening apparatus 10.

Figure 2:
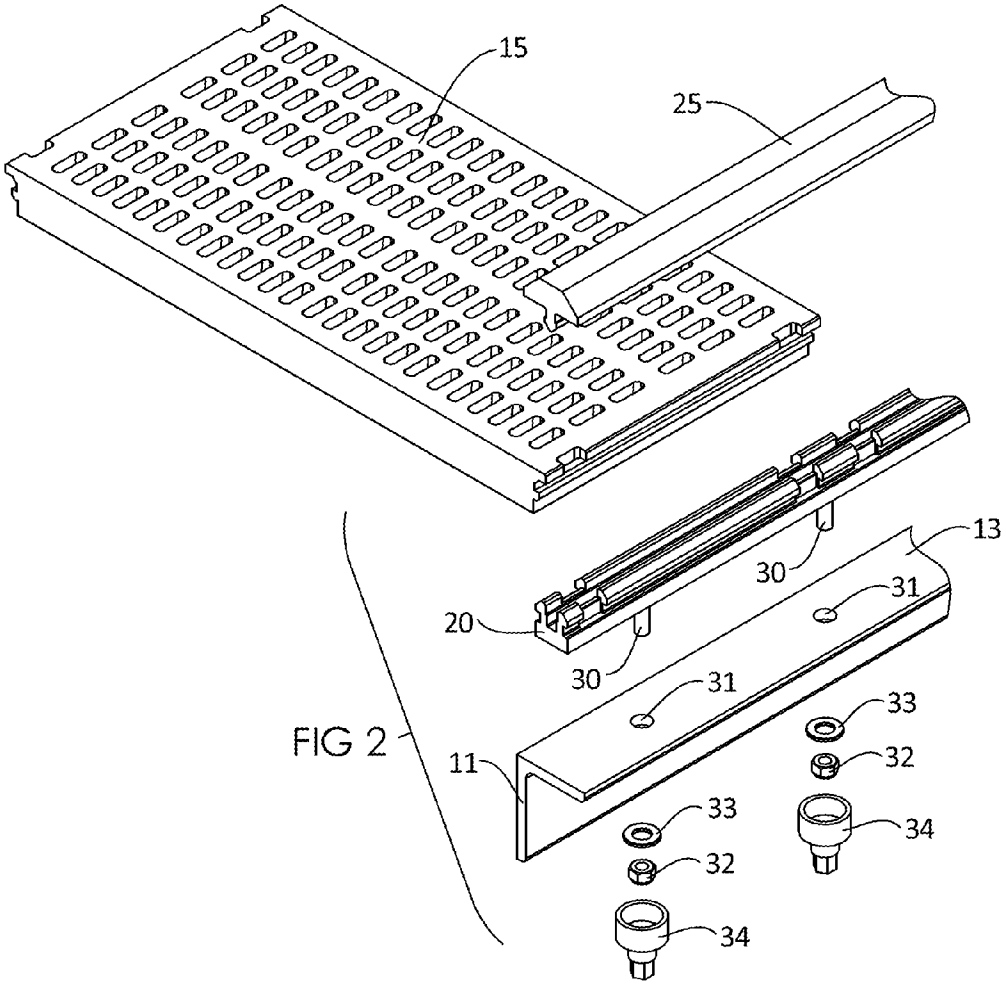
FIG. 2 is an exploded view from above of a single screening panel and the components for connection to the deck of FIG. 1.
Figure 3:
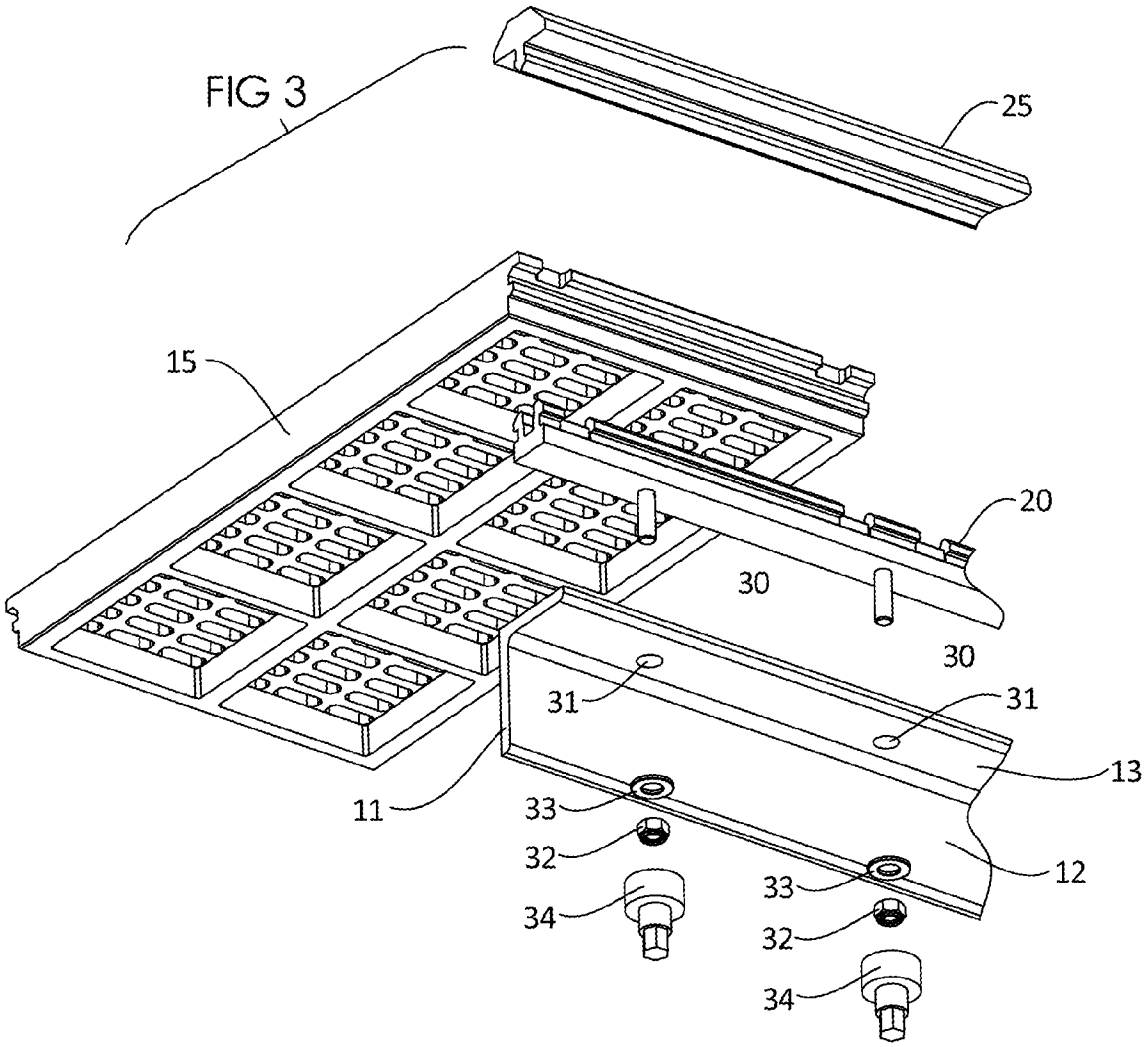
FIG. 3 is an exploded view from below of a single screening panel and the components for connection to the deck of FIG. 1.

With reference to FIGS. 2 and 3, exploded perspective views from above and below the panels 15 are shown, with the same reference numerals denoting the same features from FIG. 1. However, in FIGS. 2 and 3, only a single panel 15 is shown along with the portions of the components to which the panel is fixed. Accordingly, each of FIGS. 2 and 3 show the elongate beam 11, the fixing member 20 and the cover portion 25 as a short section only.

FIGS. 2 and 3 further show that the fixing members 20 include projections or pins 30, that extend from a lower or bottom surface of the fixing members 20 and that are spaced apart for receipt through openings 31 formed in the short section 13 of the beam 11. The pins 30 extend through the openings 31 for threaded connection with nuts 32 on the opposite side of the short portion 13 of the beams 11. The fixing arrangement further includes washers 33 and nut caps 34. The nut caps 34 can be polyurethane caps, which thread onto the end of the pins 30, and which protect the pins 30, the nuts 32 and the washers 33 from the corrosive effect of fines (very fine screening product or media). The pins 30 can be fixed relative to the fixing members 20 by embedding the pins 30 in the moulding of the fixing members 20. Alternatively, the fixing members 20 can include openings through which pins can be inserted, so that the pins are loose rather than fixed relative to the fixing members 20.

By the above arrangement, the fixing members 20 can be securely fixed to the beams 11 against movement relative to the beams 11.

Figure 4:
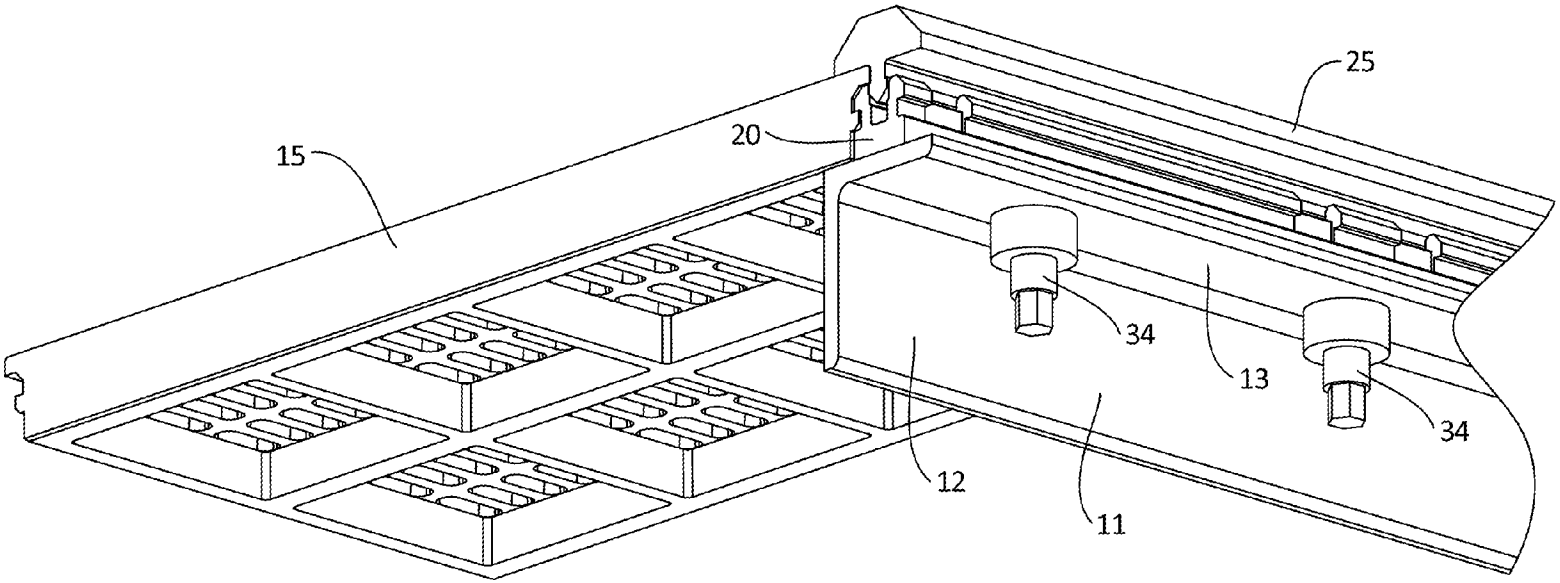
FIG. 4 is an assembled view from below of the arrangement of FIG. 3.
Figure 5:
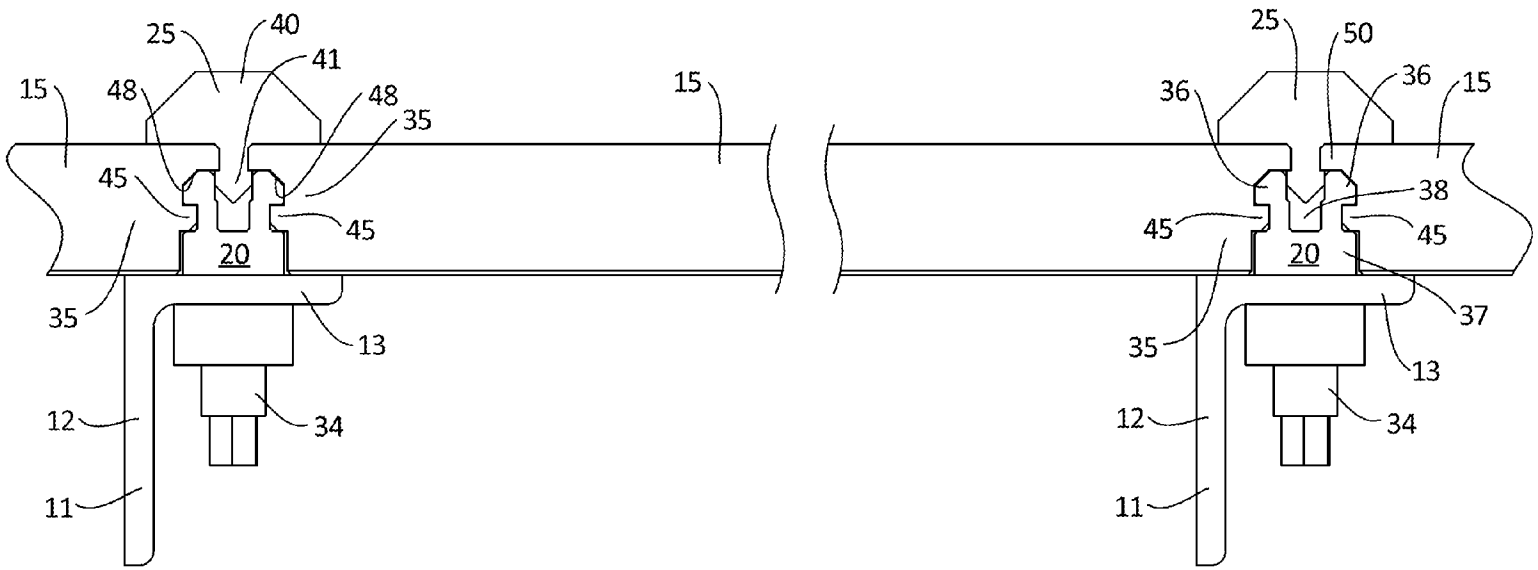
FIG. 5 is a cross sectional view through V-V of FIG. 1.

The arrangement of FIGS. 2 and 3 is shown in an assembled or fixed form in FIG. 4, while a cross-sectional view is shown in FIG. 5.

With reference to FIG. 5, a section of a screening apparatus according to the invention is shown, and it can be seen that adjacent panels 15 are mounted by the fixing members 20 so that facing side edges 35 of adjacent panels are in close facing relationship and separated by the fixing members 20 and by a portion (to be described later herein) of the cover strips 25. The panel 15 that is shown centrally of FIG. 5 is mounted to and bridges between the two beams 11 as shown in FIG. 5.

The fixing members 20 as seen in the figures discussed above include a pair of upstanding, generally longitudinal and flexible rails 36 (see the right hand fixing member 20). The rails 36 extend from a common base 37 and form a longitudinal gap or channel 38 between them. For better clarity, the arrangement of the fixing member 20 and the cover strip 25 is illustrated in isolation in FIG. 6.

Figure 6:
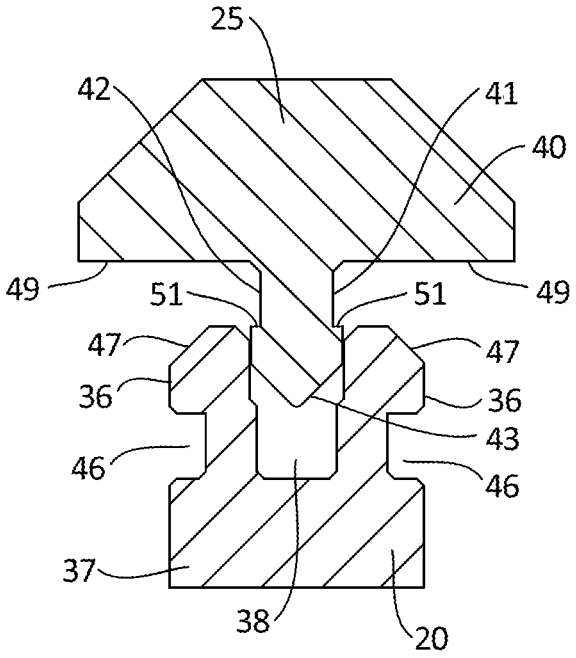
FIG. 6 is a cross-sectional view of a cover strip and fixing rail assembled together.

In FIG. 6, the cover strip 25 includes a cover portion 40 and a locking portion 41. The locking portion includes a web section 42 that extends from the cover portion 40, and a head portion 43 that extends from the web portion 42. The head section 43 is shown as having a width slightly smaller than the width between the facing surfaces of the rails 36, but in practice, and as shown in FIG. 5, it is preferable that facing surfaces between the head section 43 and the rails 36 are in engagement when assembled together. It will be appreciated that by insertion of the head 43 into the gap 38 as shown in FIGS. 5 and 6, the rails 36 are prevented from flexing inwardly and away from the side edges 35 of the adjacent panels 15. However, prior to insertion of the head 43 into the gap 38, the rails 36 can flex inwardly and this assists connection of the panels 15 to the fixing members 20 as will be explained below.

As is evident from the figures, the panels 15 are mounted to the beams 11 by cooperation between the side edges 35 of the panels 15 and the rails 36 of the fixing members 20. In the illustrated embodiment, that cooperation comprises a nesting projection and groove arrangement, whereby the side edges 35 include an elongate projection 45 that extends lengthwise of the beam 11 and that nests within an elongate groove 46 (see FIG. 6) which is formed in the rails 36 of the fixing members 20. It is also the case that the heads 47 (see FIG. 6) of the rails 36 fit into grooves 48 (see FIG. 5) formed in the side edges 35, above the projections 45. By this arrangement of cooperating grooves and projections, the nesting arrangement is such as to secure the panels 15 to the beams 11 via the fixing members 20. The cover strips 25 do not form part of the cooperating arrangement and therefore the cover strips 25 have no involvement in securing the panels 15 to the beams 11.

In order for the side edges 35 of the panels 15 to engage the rails 36 of the fixing members 20 during assembly, the rails 36 can flex inwardly towards each other so that the projection 45 can ride over the top of the rails 36 and into the groove 46. The top of the rails 36 are chamfered as shown to facilitate that riding movement. The natural resilience of the rails 36 will cause them to return to their position prior to flexing inwardly and the side edges 35 will be securely held by the fixing members 20. However, with sufficient load applied to the panels 15, there is a possibility of the side edges disengaging from the fixing members 20 by the rails flexing inwardly, and thus insertion of the locking portion 41 into the gap 38 to prevent inward flexing of the rails 36 prevents that disengagement.

Advantageously, in the arrangement of the invention, all or substantially all of the securing load to secure the panels in place on the beams is by the engagement between the side edges of the panels and the fixing members, and the cover strip bears none of that load. This enables the cover strip to be installed relatively easily as will be explained below.

The cover strips 25 are provided, as discussed above, for preventing ingress of screened product or media into the area between the facing side edges 35. Ingress of such material into that area can wear the fixing members 20, or the beams 11, and repair or replacement of those components can results in significant down time in a screening apparatus. Accordingly, the cover portion 40 of the cover strips 25 is intended to bear firmly against adjacent upper surfaces of facing side edges 35. FIG. 6 shows the bearing surface of the cover strips 25 as surfaces 49.

In order for the cover strips 25 to remain securely in place as shown in FIGS. 4 and 5, the adjacent side edges 35 of the panels 15 each include an overlying section 50 that overlies the upper ends of the rails 36 for cooperation with the locking portion 41 of the cover strip 25. That cooperation is by the lip or flange 51 shown in FIG. 6, formed between the web section 42 and the head section 43, underlying the edge of the overlying section 50 of each of the side edges 35. It is to be noted that the extent of bearing engagement between the lips 51 and the overlying section 50 can be in the order of only 1.5 mm and still securely hold the cover strips 25 in place.

It is further to be noted that the cover strips 25 can be formed from a flexible material, such as a polyurethane, and the head 46 of the locking portion 41 can be formed to have a triangular cross-section with inclined leading surfaces that allow the head to be forced past the overlying sections 50, with the lips 51 resiliently springing back into an underlying relationship with the overlying section 50, and this can be done by hand, or with the assistance of a hammer or mallet.

Figure 7:
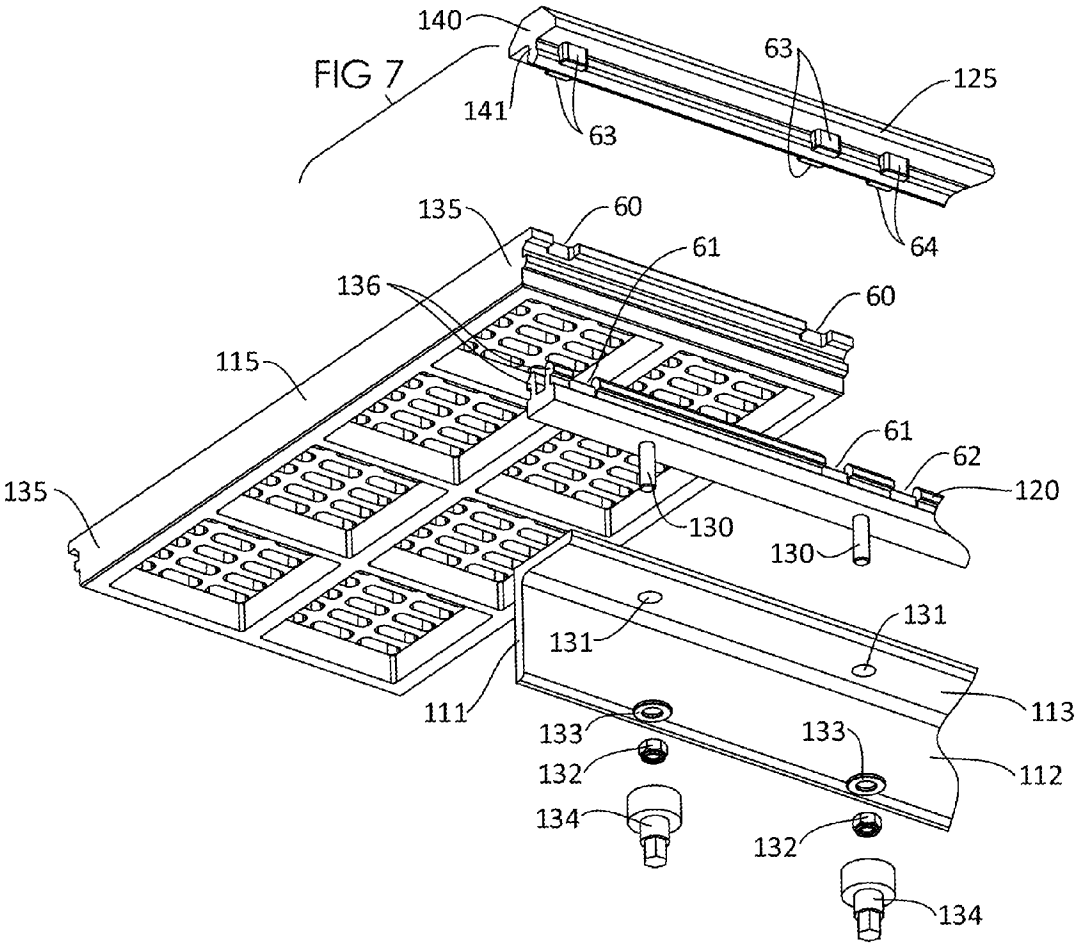
FIG. 7 is an exploded view from below of a single screening panel and the components for connection to a screening deck according to a second embodiment of the invention.
Figure 8:
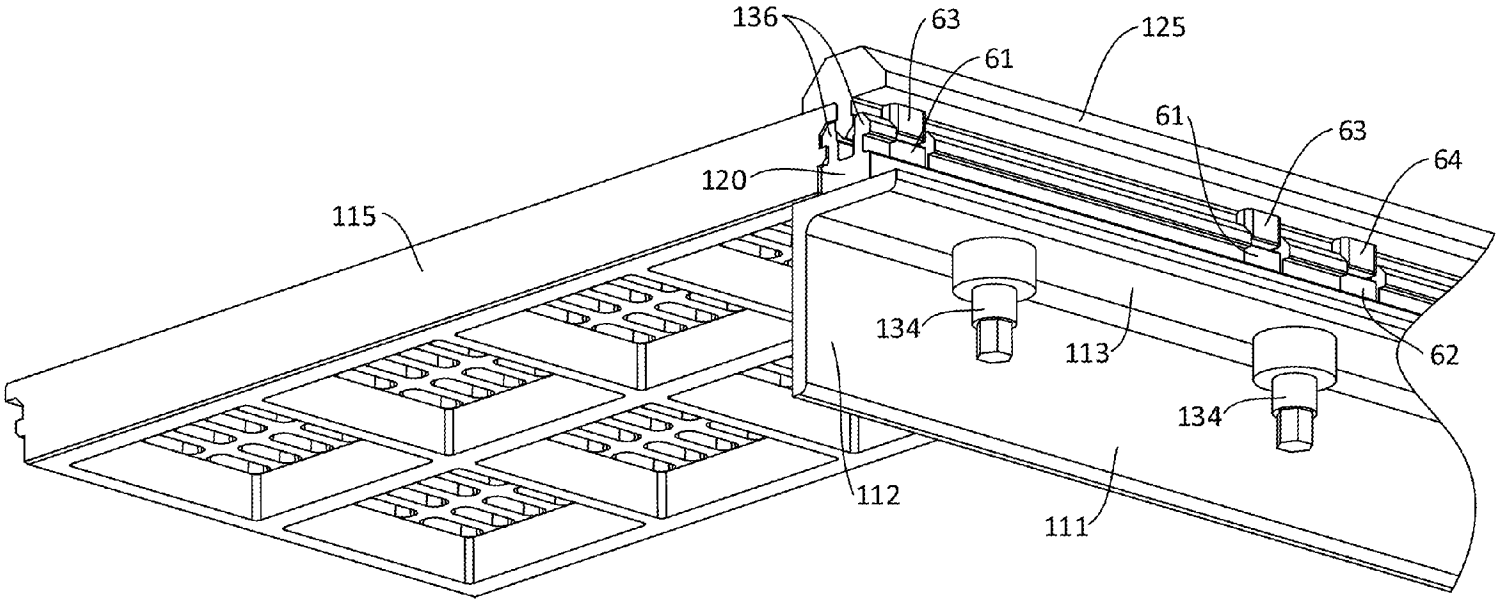
FIG. 8 is an assembled view from below of the arrangement of FIG. 7.
Figure 9:
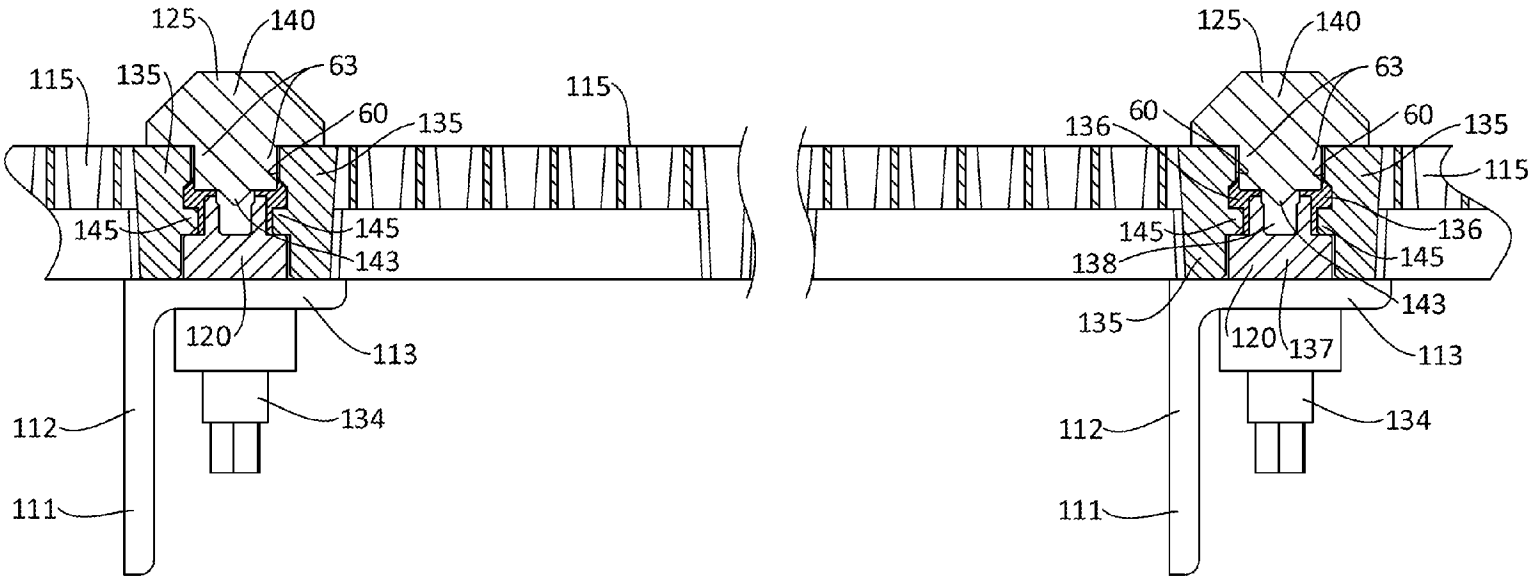
FIG. 9 is a cross sectional at the same position at FIG. 5, but in respect of the arrangement of FIGS. 7 and 8.

FIGS. 7 to 9 illustrate a further embodiment of the invention, in which locating gaps are provided in the first side edges of panels that are to be secured in a screening apparatus, for alignment with locating gaps that are formed in the upstanding rails of a fixing member, and the cover strips include locking members that extend into the locating gaps of each of the panels and the fixing members to locate the screen panels relative to the fixing member and by this arrangement, the screen panels are fixed in place against movement lengthwise of the elongate beams.

With reference to FIGS. 7 to 9, the same reference numerals are used for the same parts that are earlier shown in FIGS. 1 to 6, plus 100.

With reference to FIGS. 7 to 9, the difference in the arrangement from the screening deck 10 of the previous figures, resides in the provision of locating gaps and locking members. In FIG. 7, it can be seen that the side edge 135 of the panel 115 includes a pair of spaced apart locating gaps 60. The same gaps are provided in the other side edge 135 which is not visible in FIG. 7, but those gaps are provided at the same positions as shown in respect of the gaps 60.

Locating gaps 61 are also provided in the fixing member 120 and in FIG. 7 those locating gaps comprise locating gaps 61 (two gaps) and 62.

Still in relation to FIG. 7, locating members 63 and 64 are shown as part of the cover strip 120, extending outwardly from the locking portion 141 and extending downwardly from the cover portion 140. The locating members 63 are provided for receipt within the locating gaps 60 and 61 of the screen panel 115 and the fixing member 120 respectively. The locating members 64 are provided for receipt within the locating gaps 62 of the fixing member 120, but no complementary locating gap is shown in respect of a screen panel, because the locating gaps 62 and the locating members 64 would interact with an additional and adjacent screen panel 115 which is not illustrated in FIG. 7.

Because of the perspective nature of FIG. 7, it is not clear that the locating gaps 61 and 62 are provided in each of the upstanding rails 136 of the fixing member 120. Nevertheless, such gaps 61 and 62 are provided in each of the rails 136 and the gaps are aligned to be next to each other.

With reference to FIG. 8, the assembled version of FIG. 7 is illustrated, and in this view, it can be seen that the locating members 63 and 64 are positioned within the locating gaps 61 and 62. It will also be evident, although not shown in FIG. 8, that in the assembled form of FIG. 8, the locating members 63 are also located within the locating gaps 60 of the panel 115.

The locating members 63 have a longitudinal length such that opposite ends of the members 63 will engage facing surfaces or ends of the locating gaps 60 and 61 and because of this, the locating members 63 cannot move relative to the fixing member 120 and thus the panel 115 cannot move relative to the fixing member 120 also. The locating members thus prevent movement of the panels 115 relative to the fixing members 120 and the beams 111 so that problems previously discussed in relation to panel movement are attended to.

With reference to FIG. 9, a cross-sectional view taken through the assembly of FIG. 8, through the locating members 63 is shown, but with three screen panels 115 shown, rather than the single panel shown in FIG. 8. In FIG. 9, locating members 63 extend into locating gaps 60 of the panel 115 and into the aligned gaps 61 provided in the rails 136.

FIGS. 7 and 8 illustrate that the provision of locating members 63 and 64 can be repeated for the length of the cover strip 125, while the same can be said for the locating gaps 61 and 62 of the fixing member 120. Moreover, if the size of the panels 115 were increased, so that the length of the side edges 135 was increased, a greater number of locating gaps 60 could be provided with a complementary increase in the number of locating gaps in the fixing member 120 and in the locating members 63 and 64 of the cover strip 125.

Other than the provision of locating gaps and locating members in FIGS. 7 to 9, the assembly in FIGS. 7 to 9 is the same as the assembly shown in FIGS. 1 to 6.

The invention described herein is susceptible to variations, modifications and/or additions other than those specifically described and it is to be understood that the invention includes all such variations, modifications and/or additions which fall within the spirit and scope of the present disclosure.

Throughout the description and claims of the specification, the word "comprise" and variations of the word, such as "comprising" and "comprises", is not intended to exclude other additives, components, integers or steps.

The invention claimed is:

1. A screening apparatus, including:

a plurality of spaced apart, substantially parallel elongate beams, a plurality of screen panels mounted to the beams to form a broad screening surface, each of the panels having a generally square or rectangular shape defining a first pair of substantially parallel side edges and a second pair of substantially parallel side edges, and the panels being mounted adjacent to each other so that side edges of adjacent panels are in facing relationship, each panel being mounted to a pair of beams to bridge between two adjacent beams, the panels being mounted to the beams by elongate fixing members that extend in the longitudinal direction of the beams and that engage the first pair of side edges of the panels, the fixing members having a pair of upstanding, generally longitudinal flexible rails that are generally parallel and that are spaced apart to define a longitudinal gap between them, the panels being mounted to the beams by cooperation between the first pair of side edges of each panel with a rail of a fixing member, elongate cover strips extending lengthwise of the elongate beams and including a cover portion and a locking portion, the cover portion overlying and bearing against an upper surface of a pair of adjacent panels at the first side edges of the adjacent panels, and the locking portion extending into the gap between the longitudinal rails and bearing against facing surfaces of the longitudinal rails to resist movement of the rails towards each other first side edges of adjacent panels having overlying portions that overlie upper ends of the rails of a fixing member and the locking portion of the cover strips cooperating with the overlying portions of the panels to retain the cover strips in place.

2. A screening apparatus according to claim 1, the cooperation between the first pair of side edges of each panel and a rail of a fixing member including a projection extending from one of the side edges of each panel and the rail of a fixing member and a groove into which the projection extends that is formed in the other of the side edges of each panel and the rail of a fixing member, the projection extending generally in a plane that is parallel to the plane of the screening surface and into the groove.

3. A screening apparatus according to claim 1, the locking portion of the cover strips including a web section extending from the cover portion and a head at a free end of the web section spaced from the cover portion, the head extending laterally on either side of the web section to form lateral bearing surfaces, the lateral bearing surfaces bearing against facing surfaces of the overlying portions of the panels.

4. A screening apparatus according to claim 3, the lateral bearing surfaces being substantially parallel with the plane of the screening surface.

5. A screening apparatus according to claim 3, the head being positioned within the longitudinal gap and the width of the head being substantially equal to the width of the longitudinal gap so that side surfaces of the head bear against facing surfaces of the longitudinal rails to resist movement of the rails towards each other.

6. A screening apparatus according to claim 3, the head having a free end which is generally triangular in cross-section.

7. A screening apparatus according to claim 1, the overlying portions of the panels extending to overlie the gap between the longitudinal rails of the fixing members and cooperation between the locking portion of the cover strips and the overlying portions of the panels being with the portion of the overlying portions that overlies the gap between the longitudinal rails of the fixing members.

8. A screening apparatus according to claim 1, the locking portion of the cover strips cooperating with facing surfaces of the longitudinal rails to retain the cover strips in place.

9. A screening apparatus according to claim 1, each of the rails of each fixing member and the first side edges of adjacent panels being interrupted to form locating gaps that are aligned and the cover strips having locking members that extend into the locating gaps to locate the panels relative to the fixing member against movement of the panels along the fixing member.

10. A screening apparatus according to claim 9, the locking members being formed as part of the locking portion of the cover strips.

11. A screening apparatus according to claim 9, the first pair of edges of each screen panel including two locating gaps that are spaced apart and the rails of the fixing members including corresponding locating gaps for alignment with the locating gaps of the edges, the screen panels being located relative to the fixing rail against movement of the panel along the fixing rail by the cover strips having a pair of locking members that extend into the aligned locating gaps.

12. A screening apparatus according to according to claim 9, the locking members extending from the same position from opposite sides of the locking portion of the cover strips.

13. A screening apparatus according to claim 9, the locking members being formed on each side of the locking portion and substantially filling the space created by the aligned locating gaps of side edges of the screen panels and rails of the fixing members.

14. A screening apparatus according to claim 9, the locking members having longitudinally spaced bearing surfaces for engagement with longitudinally opposite surfaces of the aligned locating gaps of the edges of the screen panels and the rails of the fixing members.

15. A screening apparatus according to claim 9, the locking members of the locking portion of the cover strips being formed integrally with the locking portion.

16. A screening apparatus according to claim 1, the fixing rails having a longitudinal extent substantially equal to the length of the first pair of edges of a screen panel.

17. A screening apparatus according to claim 1, the fixing rails having a longitudinal extent substantially equal to the length of two or more of the first pair of edges of a screen panel.

* * * * *